US011174825B2

(12) United States Patent
Warne et al.

(10) Patent No.: US 11,174,825 B2
(45) Date of Patent: Nov. 16, 2021

(54) SEAL CONFIGURATION FOR FUEL INJECTOR

(71) Applicant: Caterpillar Inc., Deerfield, IL (US)

(72) Inventors: Derik Warne, Bloomington, IL (US); David Halteman, Normal, IL (US); Thomas J. Crowell, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/272,211

(22) Filed: Feb. 11, 2019

(65) Prior Publication Data

US 2020/0256298 A1 Aug. 13, 2020

(51) Int. Cl.
*F02M 69/04* (2006.01)
*F02M 55/00* (2006.01)
*F02M 61/16* (2006.01)

(52) U.S. Cl.
CPC ..... *F02M 55/004* (2013.01); *F02M 61/168* (2013.01); *F02M 2200/16* (2013.01); *F02M 2200/858* (2013.01)

(58) Field of Classification Search
CPC ..... F02M 55/004; F02M 61/168; F02M 2200/16; F02M 2200/858
USPC ..... 123/445
See application file for complete search history.

(56) References Cited

U.S. PATENT DOCUMENTS 3,841,277 A * 10/1974 Schafer ..... F02M 61/145 123/470
2,844,421 A 7/1985 Hayman
4,938,193 A * 7/1990 Raufeisen ..... B25B 27/023 123/467
5,167,213 A * 12/1992 Bassler ..... F02M 61/145 123/456
5,310,227 A * 5/1994 Grinsteiner ..... F16L 19/0212 285/234
5,882,012 A * 3/1999 Niwa ..... F16J 9/14 277/407
6,338,333 B1 * 1/2002 Brosseau ..... F02M 35/10085 123/456
6,701,899 B2 * 3/2004 Liskow ..... F02M 55/004 123/470
6,811,102 B2 * 11/2004 Krause ..... F02M 61/14 239/533.2

(Continued)

FOREIGN PATENT DOCUMENTS

EP 1722100 11/2006
EP 3392533 A1 10/2018

(Continued)

*Primary Examiner* — Hung Q Nguyen
*Assistant Examiner* — Anthony Donald Taylor, Jr.
(74) *Attorney, Agent, or Firm* — Harrity & Harrity LLP

(57) ABSTRACT

A seal configuration for a fuel injector is disclosed. The seal configuration may include a seal ring within a seal groove of the fuel injector. The seal ring may be formed from a first material. The seal configuration may include a spacer ring within the seal groove of the fuel injector. The spacer ring may be formed from a second material. An outer diameter of the spacer ring may be greater than a diameter of a fuel injector bore of the fuel injector. The spacer ring may be configured to be adjacent the seal ring within the seal groove to form a seal of a fuel injector slot of an engine head of an engine, and the fuel injector slot is configured to support the fuel injector.

20 Claims, 3 Drawing Sheets

(56) References Cited

U.S. PATENT DOCUMENTS 7,195,003 B2 * 3/2007 Liskow ..... F02M 55/004 123/456
7,455,050 B2 * 11/2008 Xu ..... F02M 55/005 123/468
7,556,022 B1 * 7/2009 Doherty ..... F02M 55/004 123/456
7,658,179 B2 * 2/2010 Bock ..... F02M 63/0215 123/198 DB
7,918,209 B2 * 4/2011 Fischetti ..... F02M 61/14 123/470
8,017,057 B2 * 9/2011 Edwards ..... B29C 66/5268 264/319
8,069,841 B2 * 12/2011 Giorgetti ..... F02M 55/005 123/456
8,245,697 B2 * 8/2012 Biasci ..... F02M 55/005 123/456
8,528,524 B2 * 9/2013 Hofmann ..... F02M 61/14 123/470
9,261,139 B2 * 2/2016 McCulfor ..... F16C 29/084
9,347,411 B2 * 5/2016 Friedrich ..... F02M 61/14
9,404,458 B2 * 8/2016 Kamada ..... F02M 61/14
9,435,474 B2 * 9/2016 Chaupin ..... F16L 37/084
10,107,401 B2 10/2018 Monma et al.
10,174,734 B2 * 1/2019 Reinhardt ..... F02M 61/14
2002/0084593 A1 * 7/2002 Baehl ..... F16J 15/3216 277/552
2003/0010837 A1 * 1/2003 Augustin ..... F02M 57/025 239/89
2003/0168534 A1 * 9/2003 Hohl ..... F02M 51/0671 239/587.1
2004/0020470 A1 * 2/2004 Norgauer ..... F02M 61/14 123/470
2005/0066941 A1 * 3/2005 Berger ..... F02M 61/14 123/470
2007/0163545 A1 * 7/2007 Beardmore ..... F02M 55/025 123/456
2008/0035114 A1 * 2/2008 Kawasumi ..... F02M 47/027 123/467
2008/0156298 A1 * 7/2008 Brauneis ..... F02M 61/16 123/470
2009/0121442 A1 5/2009 Uozumi et al.
2011/0000464 A1 * 1/2011 Kannan ..... F02M 55/004 123/470
2011/0272495 A1 * 11/2011 Nunic ..... F02M 61/14 239/533.2
2011/0303192 A1 12/2011 Jung
2012/0037124 A1 * 2/2012 Peters ..... F01P 3/16 123/470
2013/0014719 A1 * 1/2013 Sugiyama ..... F02M 61/14 123/188.1
2013/0167807 A1 * 7/2013 Kamada ..... F02M 61/14 123/470
2015/0040857 A1 * 2/2015 Franks ..... F02M 61/14 123/294
2016/0081857 A1 3/2016 Ha
2016/0138540 A1 * 5/2016 Franks ..... F02M 53/043 123/470
2018/0195616 A1 * 7/2018 Gronitzki ..... F16J 15/441
2018/0372223 A1 * 12/2018 Yoshitsune ..... F16J 15/104
2020/0040856 A1 2/2020 Choi

FOREIGN PATENT DOCUMENTS

JP 2008051168 A 3/2008
JP 4853633 B2 1/2012

* cited by examiner

200

SEAL CONFIGURATION FOR FUEL INJECTOR

TECHNICAL FIELD

The present disclosure relates generally to a fuel injector for an engine and, more particularly, to a seal configuration for a fuel injector.

BACKGROUND

Under operation, a fuel injector of an engine receives a force from a rocker arm when fuel is to be injected in a cylinder of an engine. The force is generally a longitudinal force on the fuel injector. A problem can occur from the force on the fuel injector causing sideloading on the fuel injector from an engine head of the engine. The sideloading may cause injector fretting and/or a seal formed from a seal ring (e.g., an o-ring) to deteriorate over time, causing fuel to leak into a lubrication chamber of the engine and/or an ignition chamber of the engine.

One approach for a "seal structure" is disclosed in U.S. Pat. No. 10,107,401 that issued to Monma et al. on Oct. 23, 2018 ("the '401 patent"). In particular, the '401 patent discloses a resin backup ring installed adjacently to a seal ring and at a position further toward a low pressure side than the sealing ring, wherein on a low pressure side of a groove bottom surface of an annular groove, a tapered surface is formed which has a diameter increasing toward the low pressure side.

While the seal structure of the '401 patent includes a resin backup ring, that resin backup ring does not prevent sideloading against a fuel injector and/or against the seal ring of the seal structure.

The seal configuration of the present disclosure solves one or more problems set forth above and/or other problems in the art.

SUMMARY

According to some implementations, a seal configuration for a fuel injector of an engine may include a seal ring within a seal groove of the fuel injector, wherein the seal ring is formed from a first material; and a spacer ring within the seal groove of the fuel injector, wherein the spacer ring is formed from a second material, wherein an outer diameter of the spacer ring is greater than a diameter of a fuel injector bore of the fuel injector, and wherein the spacer ring is configured to be adjacent the seal ring within the seal groove to form a seal of a fuel injector slot of an engine head of an engine, wherein the fuel injector slot is configured to support the fuel injector.

According to some implementations, a fuel injector may include a seal groove in a fuel injector bore; and a seal configuration configured to fit within the seal groove, wherein the seal configuration includes a seal ring that comprises a first material; and a spacer ring that comprises a second material, wherein an outer diameter of the spacer ring is greater than a diameter of the fuel injector bore, and wherein the spacer ring is configured to be adjacent the seal ring within the seal groove to form a seal of a fuel injector slot of an engine head of the engine.

According to some implementations, an engine may include an engine head that includes one or more fuel injector slots; and one or more fuel injectors installed within the one or more fuel injector slots, wherein at least one of the one or more fuel injectors includes: a seal groove; and a seal configuration configured to fit within the seal groove, wherein the seal configuration comprises: a seal ring that comprises a first material; and a spacer ring that comprises a second material that has a greater durometer than the first material, wherein the spacer ring has a substantially uniform outer diameter to absorb sideloading from an engine head of the engine, and wherein the spacer ring is configured to be adjacent the seal ring within the seal groove to form a seal of one of the one or more fuel injector slots.

DETAILED DESCRIPTION

This disclosure relates to a seal configuration for a fuel injector of an engine. The seal configuration has universal applicability to any engine utilizing such a fuel injector. The engine may be any type of engine that utilizes fuel injectors, such as an internal combustion engine, a diesel engine, and/or the like.

Figure 1:
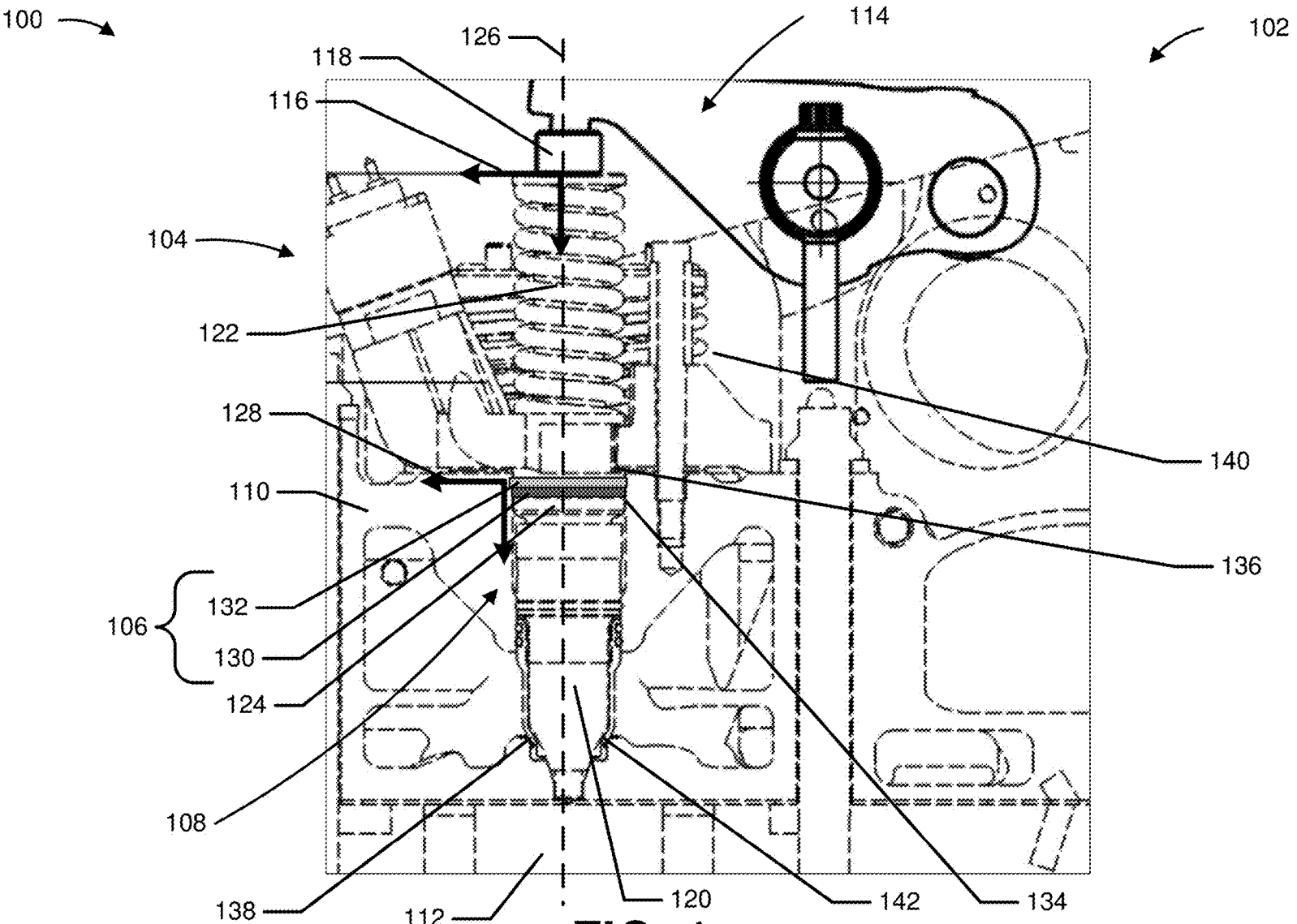
FIG. 1 is a diagram of an example implementation of an engine that includes a fuel injector with a seal configuration described herein.

FIG. 1 is a diagram of an example implementation 100 of an engine 102 that includes a fuel injector 104 with an example implementation of a seal configuration 106 described herein. As shown, fuel injector 104 is received within a fuel injector slot 108 of an engine head 110 of engine 102. Fuel injector 104 is configured to inject fuel into a cylinder 112 of engine 102. For example, when a rocker arm 114 of engine 102 applies a force 116 on a rocker end 118 of fuel injector 104, fuel injector 104 fuel is pressurized and/or released through a nozzle 120 and into cylinder 112. The fuel may be pressurized and/or released via a plunger 122 within a fuel injector bore 124 of fuel injector 104. Force 116 may be primarily longitudinal to move plunger 122 along a longitudinal axis 126 of fuel injector 104. However, as shown, force 116 may include a lateral component. The lateral component causes a sideload force 128 (which may be referred to herein as "sideloading") on fuel injector 104 from engine head 110 (or vice versa).

Seal configuration 106 of fuel injector 104 is positioned to absorb sideload force 128 to prevent sideloading between engine head 110 and fuel injector bore 124. Seal configuration 106 may be positioned toward a receiving end of engine head 110. As shown, seal configuration 106 includes a seal ring 130 and a spacer ring 132. Spacer ring 132 may be adjacent seal ring 130 within a seal groove 134 of fuel injector 104. Seal groove 134 may be annular and have a height (or length) that is substantially the same as a combined thickness of seal ring 130 and spacer ring 132. In some implementations, spacer ring 132 is positioned on a low pressure side 136 of seal configuration 106, and seal ring 130 may be positioned on a high pressure side 138 of seal configuration 106. Low pressure side 136 may correspond to a lubrication chamber 140 (or have a pressure corresponding to lubrication chamber 140) of engine 102 and high pressure side 138 may correspond to a fuel receiving chamber 142 of engine head 110 and/or cylinder 112 (or have a pressure corresponding to a pressure in fuel receiving chamber 142 and/or cylinder 112). Fuel receiving chamber 142 may be formed within fuel injector slot 108 when fuel injector 104 is installed within engine head 110. Accordingly, seal ring 130 may be configured to prevent fuel from leaking from high pressure side 138 to low pressure side 136 of seal configuration 106.

Seal ring 130 may be formed of a material having a hardness measurement of 75 durometer or less (e.g., a material with a durometer of 75 Shore hardness units or less). For example, seal ring 130 may be formed from a rubber material, a plastic material, and/or the like. Spacer ring 132 may be formed from a material having a greater durometer than seal ring 130. For example, spacer ring 132 may be formed from a polytetrafluroethylene (PTFE) material.

In this way, seal configuration 106 is configured to absorb sideload force 128 and prevent fuel injector bore 124 of fuel injector 104 from experiencing sideloading with respect to engine head 110.

As indicated above, FIG. 1 is provided as an example. Other examples may differ from what is described in connection with FIG. 1.

Figure 2:
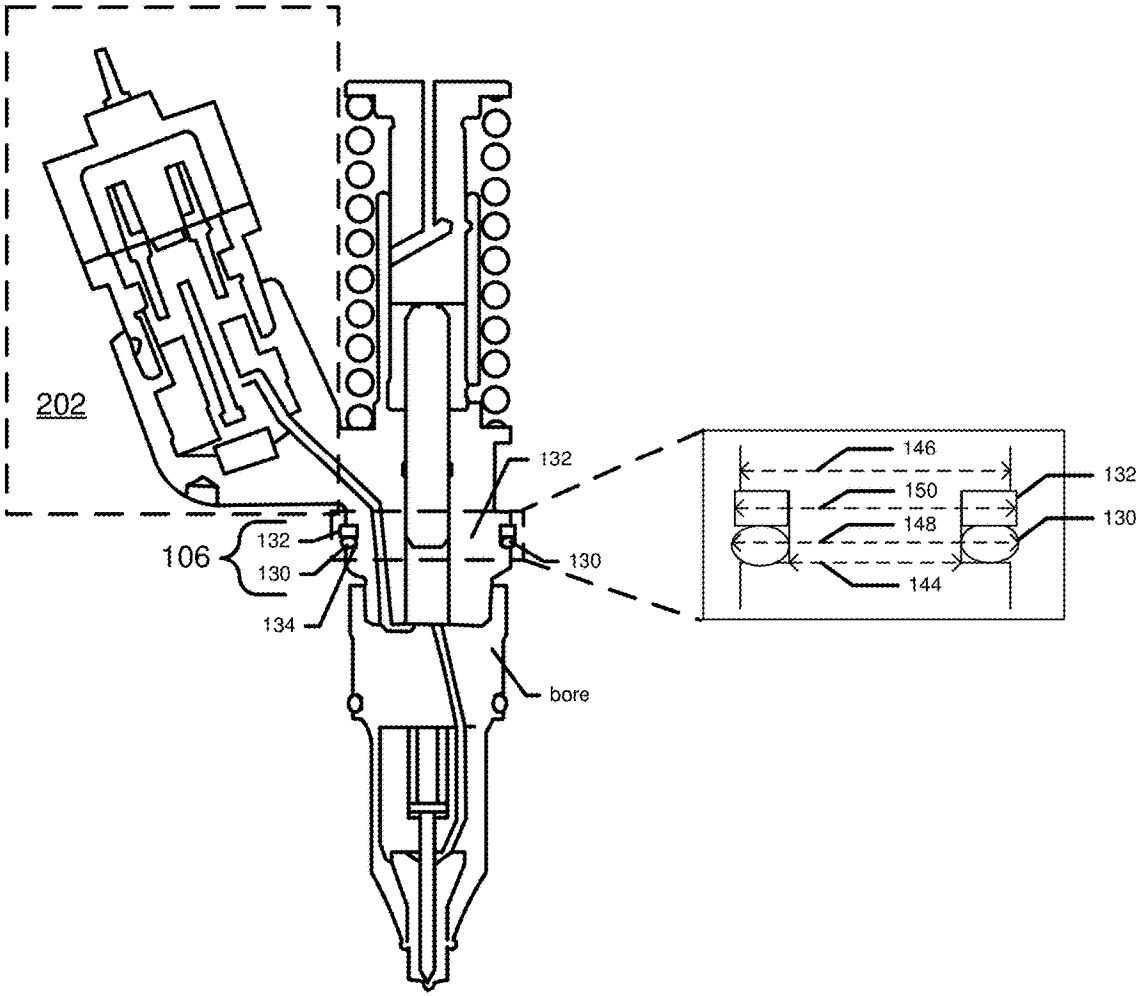
FIG. 2 is a diagram of a cross-sectional view of an example implementation of a fuel injector with the seal configuration of FIG. 1.

FIG. 2 is a diagram of a cross-sectional view of an example implementation 200 of a fuel injector 104 with the seal configuration 106 of FIG. 1. As shown in FIG. 2, seal groove 134 is positioned on fuel injector 104 at or near a base of a pressurization chamber 202. Seal configuration 106 may be between the base of pressurization chamber 202 and nozzle 120. As shown in FIG. 2, seal groove 134 has an inner diameter 144 and an outer diameter 146. Outer diameter 146 of seal groove 134 may correspond to an outer diameter of fuel injector bore 124 (and/or fuel injector 104). Inner diameter 144 of seal groove 134 may correspond to an inner diameter of seal ring 130 and/or an inner diameter of spacer ring 132.

As shown in FIG. 2, an outer diameter 148 of seal ring 130, when not compressed (or not installed within fuel injector slot 108), may be greater than a diameter of fuel injector bore 124 and/or seal groove 134. In some implementations, outer diameter 148 of seal ring 130 is greater than an outer diameter 150 of spacer ring 132. The outer diameter 148 of seal ring 130 may be greater than outer diameter 150 of spacer ring 132 before fuel injector 104 is installed within fuel injector slot 108 and may be formed to be substantially the same as outer diameter 150 of spacer ring 132 when fuel injector 104 is installed within fuel injector slot 108 (e.g., based on the durometer of seal ring 130).

As further shown in FIG. 2, spacer ring 132 may have an outer diameter that is greater than a diameter of fuel injector bore 124 and/or greater than a diameter of seal groove 134. The outer diameter of spacer ring 132 may be substantially uniform so that an external surface of spacer ring 132 is adjacent engine head 110. Spacer ring 132 may have an inner diameter that is substantially the same (e.g., within a manufacturing tolerance) as an inner diameter of seal groove 134.

Accordingly, spacer ring 132, when positioned within seal groove 134, may absorb sideload force 128. Accordingly, spacer ring 132 prevents sideloading between fuel injector 104 (e.g., between fuel injector bore 124) and engine head 110.

As indicated above, FIG. 2 is provided as an example. Other examples may differ from what is described in connection with FIG. 2.

Figure 3:
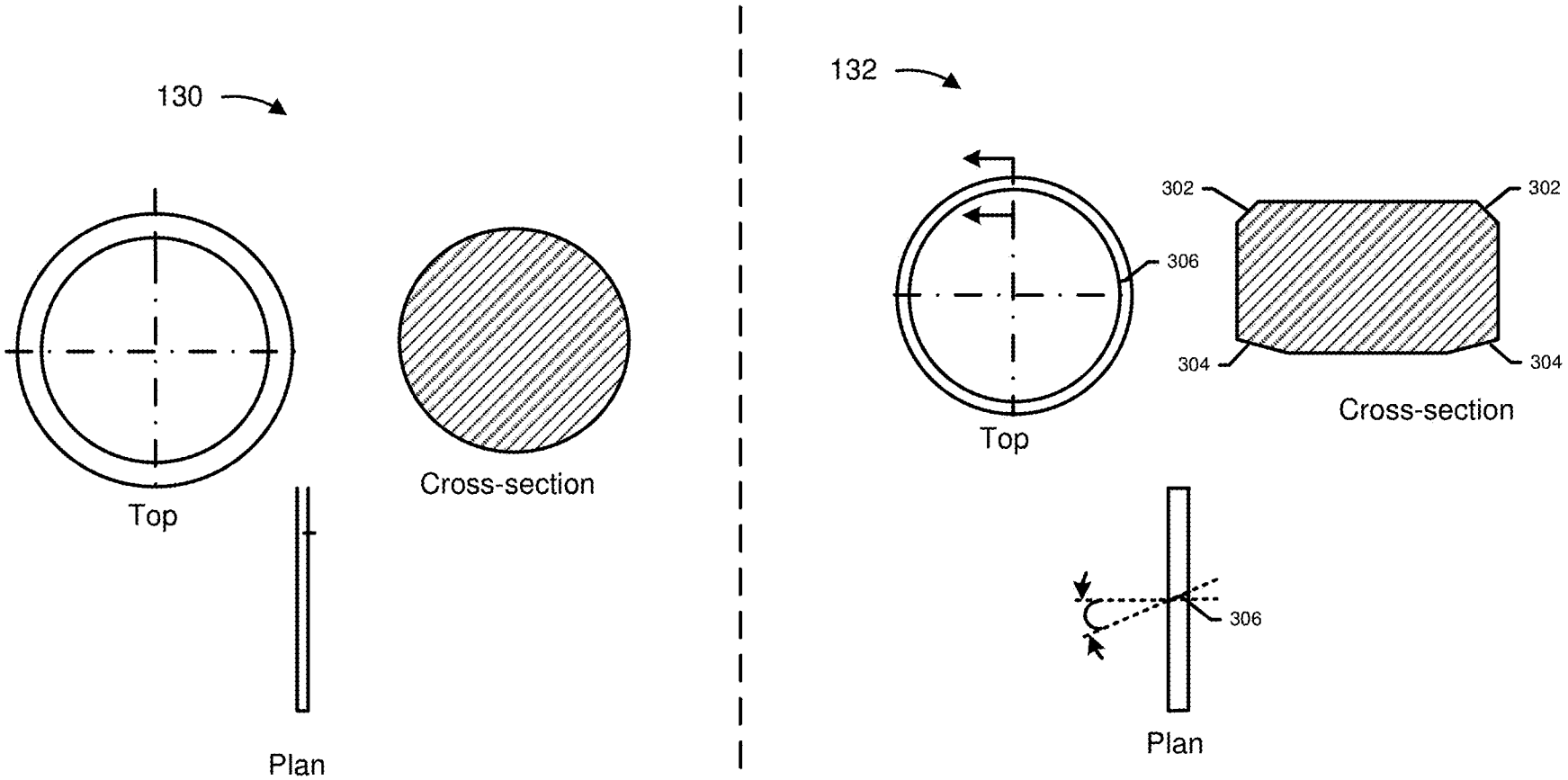
FIG. 3 includes diagrams of one or more example implementations of components of a seal configuration described herein.

FIG. 3 includes diagrams of one or more example implementations of components of a seal configuration 106 described herein. FIG. 3 includes a top view, a plan view, and a cross section of seal ring 130 and of spacer ring 132. As shown, in FIG. 3, seal ring 130 may be an O-ring with a circular cross section. The dimensions of seal ring 130 may be any suitable dimensions configured to provide a seal for fuel injector 104 based on the dimensions of fuel injector 104.

As further shown in FIG. 3, spacer ring 132 may have a substantially rectangular cross section. In some implementations, as shown by the cross section of spacer ring 132, spacer ring 132 may include a first set of chamfers 302 on a first side (e.g., a low pressure side) of the rectangular cross-section and a second set of chamfers 304 on a second side (e.g., a high pressure side) of the rectangular cross-section, opposite the first side. In some implementations, dimensions and/or slopes of the first set of chamfers 302 are different from the dimensions and/or slopes of the second set of chamfers 304.

Furthermore, spacer ring 132 may include a separable joint 306. Separable joint 306 enables spacer ring 132 to flex apart to permit spacer ring 132 to be installed within seal groove 134 of fuel injector 104. The slope of the first set of chamfers 302 and/or the second set of chamfers 304 may be configured to provide ease of installation of the spacer ring 132 within seal groove 134. For example, the first set of chamfers 302 and the second set of chamfers 304 may remove rigid edges of spacer ring 132 that may grip fuel injector bore 124 during installation of spacer ring 132.

In this way, seal ring 130 and/or spacer ring 132 may be shaped to fit within seal groove 134 to form seal configuration 106 and prevent sideloading between fuel injector 104 and engine head 110, as described herein.

As indicated above, FIG. 3 is provided as an example. Other examples may differ from what is described with regard to FIG. 3.

INDUSTRIAL APPLICABILITY

The disclosed seal configuration 106 may be used with any engine where a proper seal is desired to prevent fuel from a fuel injector leaking into a lubrication chamber of an engine or within a cylinder of the engine. As described herein, the seal configuration 106 may prevent sideloading on fuel injector 104 from an engine head of the engine. The seal configuration 106 may prevent the sideloading due to the diameter of a spacer ring 132 being greater than a diameter of a fuel injector bore 124 of fuel injector 104. Furthermore, the seal configuration 106 may prevent the sideloading due to the material and/or a durometer of the material being greater than a durometer of spacer ring 132 of the seal configuration 106. Moreover, a substantially uniform outer diameter 150 of spacer ring 132 provides an enhanced ability to withstand sideloading on fuel injector 104 from engine head 110. The substantially uniform outer diameter can withstand greater sideloading than a variable or tapered outer diameter because an external surface of spacer ring 132 can receive more force than if spacer ring 132 included a variable or tapered outer diameter. Moreover, seal configuration 106 may be placed on fuel injector 104 at a location of fuel injector 104 (at a location of fuel injector bore 124) that withstands a greatest amount or a high amount of sideloading (e.g., relative to other locations of fuel injector 104) from engine head 110 during operation. For example, seal configuration 106 may be placed at a base of a pressurization chamber 202 and/or between pressurization chamber 202 and a fuel receiving chamber 142 of engine head 110.

Furthermore, seal configuration 106 may provide an improved seal due to the durometer of seal ring 130 being less than or equal to 75 durometer. The relatively low durometer of seal ring 130 enables relatively more compression of seal ring 130 within seal groove 134, against spacer ring 132, and against engine head 110. In this way, fuel is less likely to leak between seal ring 130 and fuel injector 104 and/or between seal ring 130 and engine head 110.

Further, spacer ring 132 may enable relatively simple maintenance, replacement, and/or installation of seal configuration 106 with seal groove 134 of fuel injector 104. For example, separable joint 306 and/or sets of chamfers 302, 304 permit spacer ring 132 to be quickly and efficiently removed and/or installed within seal groove 134 of fuel injector 104. Accordingly, seal configuration 106 can be quickly and efficiently installed, replaced, and/or maintained within seal groove 134 of fuel injector 104.

As used herein, the articles "a" and "an" are intended to include one or more items, and may be used interchangeably with "one or more." Also, as used herein, the terms "has," "have," "having," or the like are intended to be open-ended terms. Further, the phrase "based on" is intended to mean "based, at least in part, on."

The foregoing disclosure provides illustration and description, but is not intended to be exhaustive or to limit the implementations to the precise forms disclosed. Modifications and variations may be made in light of the above disclosure or may be acquired from practice of the implementations. It is intended that the specification be considered as an example only, with a true scope of the disclosure being indicated by the following claims and their equivalents. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

What is claimed is:

1. A seal configuration for a fuel injector of an engine, the seal configuration comprising:

a seal ring provided within a seal groove of the fuel injector, wherein the seal ring is formed from a first material; and a spacer ring provided within the seal groove of the fuel injector, wherein the spacer ring is formed from a second material that is different from the first material, wherein the spacer ring includes a first set of chamfers on an uppermost portion of a cross-section of the spacer ring and a second set of chamfers on a lowermost portion of the cross-section of the spacer ring, wherein the uppermost portion extends between a first chamfer and a second chamfer of the first set of chamfers and the lowermost portion extends between a first chamfer and a second chamfer of the second set of chamfers such that the uppermost portion is substantially parallel to the lowermost portion, wherein one or more of dimensions or slopes of the first set of chamfers are different from one or more of dimensions or slopes of the second set of chamfers, wherein the spacer ring is configured to be adjacent to the seal ring within the seal groove to form a seal of a fuel injector slot of an engine head of the engine, and wherein the fuel injector slot is configured to support the fuel injector.

2. The seal configuration of claim 1, wherein a durometer of the first material is less than a durometer of the second material.

3. The seal configuration of claim 1, wherein the first material comprises a rubber material.

4. The seal configuration of claim 1, wherein a thickness of the seal ring is substantially the same as a thickness of the spacer ring.

5. The seal configuration of claim 1, wherein the second material comprises a polytetrafluoroethylene (PTFE) material.

6. The seal configuration of claim 1, wherein an outer diameter of the spacer ring is substantially uniform, such that an external surface of the spacer ring is substantially adjacent to the engine head when the fuel injector is received in the fuel injector slot.

7. The seal configuration of claim 1, wherein the cross-section of the spacer ring is a substantially rectangular cross-section.

8. The seal configuration of claim 1, wherein an inner diameter of the seal ring and an inner diameter of the spacer ring are substantially the same as an inner diameter of the seal groove.

9. The seal configuration of claim 1, wherein an outer diameter of the spacer ring is greater than an outer diameter of the seal groove.

10. The seal configuration of claim 1, wherein an outer diameter of the seal ring, before the fuel injector is installed in the fuel injector slot, is greater than a diameter of the fuel injector slot, and wherein the outer diameter of the seal ring, after the fuel injector is installed in the fuel injector slot, is formed to be substantially the same as an outer diameter of the spacer ring based on a durometer of the seal ring.

11. A fuel injector configured to be installed in a fuel injector slot of an engine head of an engine, the fuel injector comprising:

a seal groove in a fuel injector bore; and a seal configuration configured to fit within the seal groove, wherein the seal configuration comprises:

a seal ring that comprises a first material; and a spacer ring that comprises a second material that is different from the first material, wherein the seal ring is configured to be positioned on a high pressure side of the seal configuration, wherein the high pressure side corresponds to a fuel receiving chamber of the engine head of the engine, wherein the spacer ring includes a first set of chamfers on an upper side of a cross-section of the spacer ring and a second set of chamfers on a lower side of the cross-section of the spacer ring, wherein the upper side extends between a first chamfer and a second chamfer of the first set of chamfers and the lower side extends between a first chamfer and a second chamfer of the second set of chamfers such that the upper side is substantially parallel to the lower side, wherein one or more of dimensions or slopes of the first set of chamfers are different from one or more of dimensions or slopes of the second set of chamfers, and wherein the spacer ring is configured to be adjacent to the seal ring within the seal groove to form a seal of the fuel injector slot of the engine head of the engine.

12. The fuel injector of claim 11, wherein the seal groove has a height that is substantially the same as a combined thickness of the spacer ring and the seal ring.

13. The fuel injector of claim 11, wherein the seal ring is situated between the spacer ring and the fuel receiving chamber of the engine head.

14. The fuel injector of claim 13, wherein the seal ring forms a seal between the fuel receiving chamber and a lubrication chamber of the engine head.

15. The fuel injector of claim 11, wherein the fuel injector slot forms the fuel receiving chamber of the engine head, wherein the seal configuration is situated between the fuel receiving chamber and a lubrication chamber of the engine head.

16. The fuel injector of claim 11, further comprising:

a pressurization chamber; and a nozzle, wherein the seal groove is between the pressurization chamber and the nozzle.

17. An engine comprising:

an engine head that includes one or more fuel injector slots; and one or more fuel injectors installed within the one or more fuel injector slots, wherein at least one of the one or more fuel injectors includes:

a seal groove; and a seal configuration configured to fit within the seal groove, wherein the seal configuration comprises:

a seal ring that comprises a first material; and a spacer ring that comprises a second material that is different from the first material and has a greater durometer than the first material, wherein the spacer ring includes a first set of chamfers on an uppermost portion of a cross-section of the spacer ring and a second set of chamfers on a lowermost portion of the cross-section of the spacer ring, wherein the uppermost portion extends between a first chamfer and a second chamfer of the first set of chamfers and the lowermost portion extends between a first chamfer and a second chamfer of the second set of chamfers such that the uppermost portion is substantially parallel to the lowermost portion, wherein one or more of dimensions or slopes of the first set of chamfers are different from one or more of dimensions or slopes of the second set of chamfers, and wherein the spacer ring is configured to be adjacent to the seal ring within the seal groove to form a seal of one of the one or more fuel injector slots.

18. The engine of claim 17, wherein the seal configuration is situated between a lubrication chamber of the engine head and a fuel receiving chamber of at least one of the one or more fuel injector slots.

19. The engine of claim 17, wherein the spacer ring is configured to be positioned on a low pressure side of the seal configuration, and wherein the seal ring is configured to be positioned on a high pressure side of the seal configuration.

20. The seal configuration of claim 1, wherein the slopes of the first set of chamfers are different from the slopes of the second set of chamfers.

* * * * *